US005642424A

United States Patent [19]

Masaki

[11] Patent Number: 5,642,424

[45] Date of Patent: Jun. 24, 1997

[54] DEVICE FOR CONNECTING EXTERNAL SOUND GENERATOR

[75] Inventor: Tateo Masaki, Chiba, Japan

[73] Assignee: Uniden Corporation, Chiba, Japan

[21] Appl. No.: 291,241

[22] Filed: Aug. 16, 1994

[30] Foreign Application Priority Data

Jan. 6, 1994 [JP] Japan ..... 6-000198

[51] Int. Cl.[6] ..... H04R 5/00

[52] U.S. Cl. ..... 381/25; 381/1; 330/149; 330/306

[58] Field of Search ..... 381/25, 1; 330/149, 330/306

[56] References Cited

U.S. PATENT DOCUMENTS

| | | | |
|---|---|---|---|
| 4,433,209 | 2/1984 | Kurosawa et al. | 381/25 |
| 5,001,774 | 3/1991 | Lee | 381/25 |

FOREIGN PATENT DOCUMENTS

| | | |
|---|---|---|
| 0155291 | of 0000 | Japan . |
| 55-72793 | 5/1980 | Japan . |
| 60-32774 | 3/1985 | Japan . |
| 60-155291 | 10/1985 | Japan . |
| 192595 | 12/1985 | Japan . |
| 64-54471 | 4/1989 | Japan . |

OTHER PUBLICATIONS

Radio Shack, Linear Applications, vol. 1, Dec. 1972, pp. AN69–1–AN69–7.

*Primary Examiner*—Curtis Kuntz
*Assistant Examiner*—Duc Nguyen
*Attorney, Agent, or Firm*—Fish & Richardson, P.C.

[57] ABSTRACT

A device for connecting an external sound generator having a plug and being incorporated in an apparatus having a circuit outputting an electrical sound signal. The external sound generator is, for instance, either one of a headphone having the plug of 3-pole stereophonic type or a earphone having the plug of 2-pole monophonic type. The device comprises a single jack having a first and second plus contacts and a minus contact for receiving the electrical sound signal from the outputting circuit through the first plus contact and for supplying the electrical sound signal to the plug connected to the jack and an impedance element, such as a electric resistor, connected between the first and second plus contacts. The impedance element prevents a short circuit for use of an earphone having a 2-pole monophonic plug.

3 Claims, 8 Drawing Sheets

DEVICE FOR CONNECTING EXTERNAL SOUND GENERATOR

BACKGROUND OF THE INVENTION

The present invention relates to a device for connecting an external sound generator, and more particularly to the connecting device having a single jack applicable to the external sound generator which has either one of a 3-pole stereophonic plug and a 2-pole monophonic plug.

Telecommunication systems, such as a transceiver or receiver, usually incorporate a built-in speaker and often additionally incorporate a 2-pole monophonic jack for connecting an external speaker or earphone.

FIG. 1 exemplifies such a telecommunication system incorporating a 2-pole monophonic jack 2. The 2-pole monophonic jack 2, as shown in the figure, comprises a minus contact 4, a plus contact 6, and an armature 8 which opens and closes against the plus contact 6 in response to the insertion and pulling out of a 2-pole monophonic plug 20. The plus contact 6 is connected to a low frequency power amplifier 10 via a DC cut-off capacitor 12. The armature 8 is connected to a built-in speaker 14.

The above-mentioned 2-pole monophonic plug 20 comprises a plus-pole member 22 and a minus-pole member 24, which are electrically connected to an earphone 26, as shown in FIGS. 1 and 2.

Accordingly, inserting the 2-pole monophonic plug 20 into the jack 2 enables the earphone 26 to supply sound. Under noisy circumstances such as a site of construction, it is sometimes required to use an enclosed-type headphone. However, the enclosed-type headphone with the 2-pole monophonic plug is not easily available because of a poor demand. A stereophonic headphone with a 3-pole stereophonic plug is easily available for music appreciation. Therefore, there is a strong demand for such stereophonic headphone instead of the enclosed-type headphone.

Conventionally, using a stereophonic headphone with a 3-pole stereophonic plug has required a 3-pole stereophonic jack. FIGS. 3 and 4 explain such a combination.

FIG. 3 shows a telecommunication system having a typical 3-pole stereophonic jack 42. The jack 42 comprises a minus contact 44, a first plus contact 46, a second plus contact 48, and armatures 50 and 52 which opens and closes against the first and second plus contacts 46 and 48, respectively, by inserting and pulling out a 3-pole stereophonic plug 30. The first and second contacts 46 and 48 are connected to a low frequency power amplifier 10 by way of a DC cut-off capacitor 12. The armature 50 is coupled with a built-in speaker 14.

The 3-pole stereophonic plug 30, meanwhile, comprises a left-channel plus member 32, a right-channel plus member 34, and a minus member 36. As shown in FIG. 4, the left-channel plus member 32 is connected to a left-channel headphone 38, whereas the right-channel plus member 34 to a right-channel headphone 40. The minus member 36 is coupled with both of the left-and right-channel headphones 38 and 40.

In consequence, inserting the 3-pole stereophonic plug 30 into the 3-pole stereophonic jack 42 permits both the left- and right-channel headphones 38 and 40 to provide monophonic sound, respectively.

However, when the 2-pole monophonic plug 20 shown in FIGS. 1 and 2 is inserted into the 3-pole stereophonic jack 42 shown in FIGS. 3 and 4, the minus member 24 of the plug 20 makes contact with both the minus contact 44 and the second plus contact 48, thereby shorting alternatingly the output of the low frequency power amplifier 10, as represented in FIG. 5. (Namely, in FIG. 5, an output voltage Vo=0; a reference Z2 represents an impedance of the monophonic earphone 26.) This short circuit causes an excessive current and leads to a high possibility of damage to the amplifier 10.

This means that an earphone with a 2-pole monophonic plug cannot be used to such a 3-pole stereophonic jack.

To avoid this inconvenience, it is suggested that two dedicated jacks to a 3-pole stereophonic plug and 2-pole monophonic plug be arranged in the same objective apparatus.

However, such arrangement will increase manufacturing cost and require a large space to build in the two types of jack, thus deteriorating a compact system.

SUMMARY OF THE INVENTION

Accordingly, it is an object of the present invention to provide a device being able to selectively connect both of a headphone and earphone, one of which is stereophonic type and the other is monophonic type.

It is another object of the present invention to provide a device being able to selectively connect both of a headphone and earphone, in which a volume of sound is additionally adjusted.

To achieve such objects, as one aspect of the present invention, there is provided a device for connecting an external sound generator having either one of a 3-pole stereophonic plug and a 2-pole monophonic plug and being incorporated in an apparatus having a circuit outputting an electrical sound signal, the device comprising: a single jack being connected to the plug and supplying the electrical sound signal to the plug; and an impedance element being connected to the jack and avoiding a short of the electrical sound signal.

As another aspect of the present invention, there is provided a device for connecting an external sound generator having a plug and being incorporated in an apparatus having a circuit outputting an electrical sound signal, the device comprising: a single jack having a first and second plus contacts and a minus contact for receiving the electrical sound signal from the outputting circuit through the first plus contact and for supplying the electrical sound signal to the plug connected to the jack; and an impedance element connected between the first and second plus contacts.

Still another aspect of the present invention, there is a device for connecting an external sound generator having a plug and being incorporated in an apparatus having a circuit outputting an electrical sound signal and a built-in speaker, the device comprising: a single jack having a first and second plus contacts, a minus contact, and an armature opening and closing against the first plus contact in response to insertion and pulling out of the plug into and from the jack, the first and second plus contacts and the minus contact receiving the electrical sound signal from the outputting circuit through the first plus contact and supplying the electrical sound signal to the plug connected to the jack and the armature being connected to the built-in speaker; and an impedance element connected between the first and second plus contacts.

It is preferred that the external sound generator is either one of a first sound generating element having the plug of 3-pole stereophonic type and a second sound generating element having the plug of 2-pole monophonic type. Preferably, the first sound generating element is a stereophonic headphone and the second generating element is a monophonic earphone. Still preferably, the impedance element is an electric resistor. It is preferred that the device further comprising a further impedance element, for example, an electric resistor, connected between the minus contact and an earth.

It is also preferred that the outputting circuit comprises a low frequency power amplifier and a DC cut-off capacitor. Preferably, the apparatus is a telecommunication apparatus.

BRIEF DESCRIPTION OF THE DRAWINGS

The accompanying drawings, which are incorporated in and constitute a part of this specification, illustrate embodiments of the present invention and, together with the description, serve to explain the principles of the present invention. In the drawings.

DESCRIPTION OF THE PREFERRED EMBODIMENTS

Figure 1:
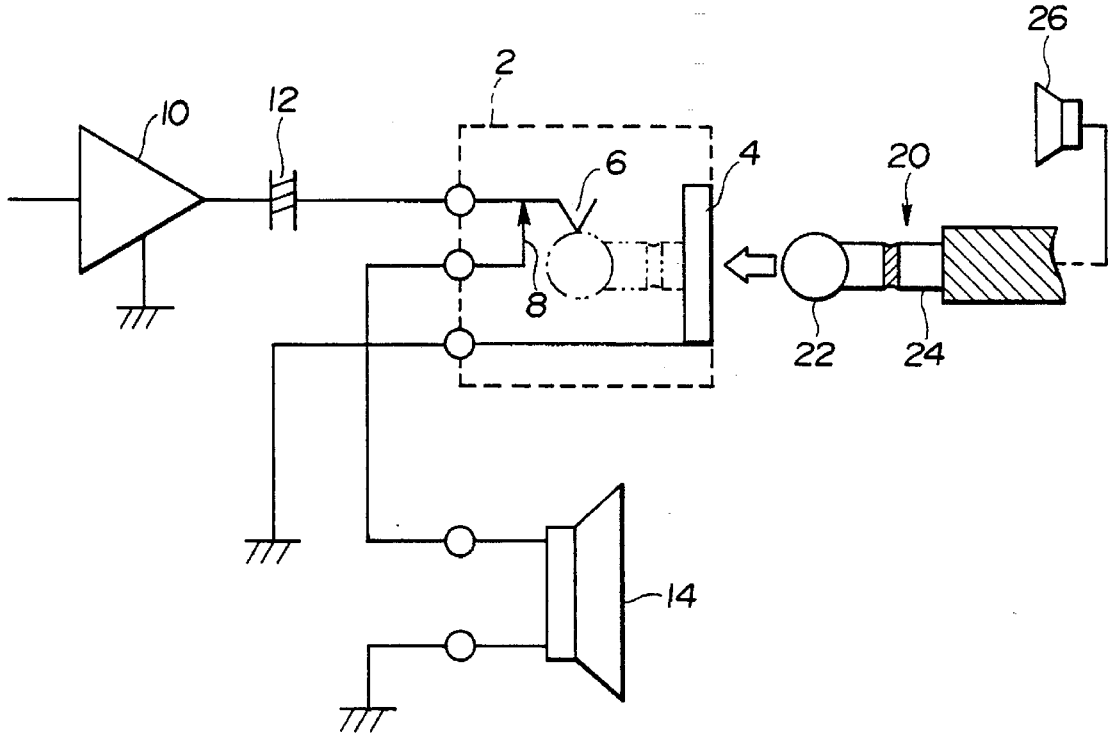
FIG.1 (PRIOR ART)
FIG. 1 is a block diagram of a conventional telecommunication apparatus having a 2-pole monophonic jack.
Figure 2:
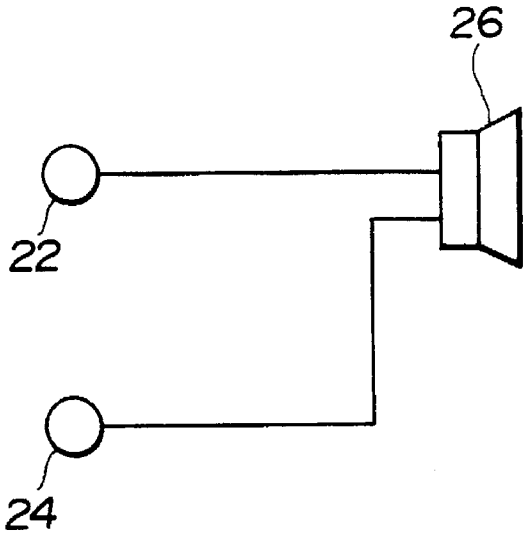
FIG.2 (PRIOR ART)
FIG. 2 is a circuit of a monophonic earphone with a 2-pole monophonic plug.
Figure 4:
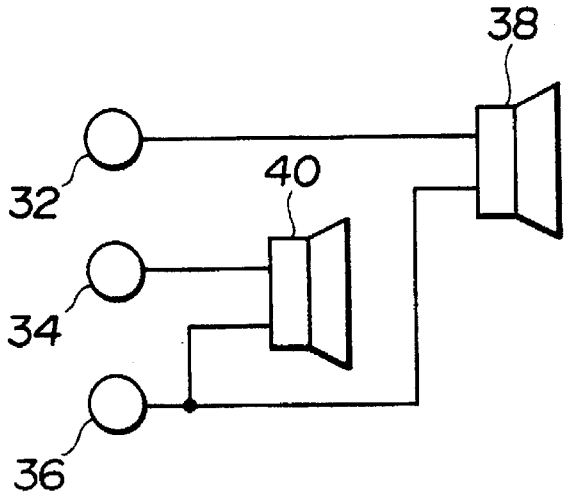
FIG.4 (PRIOR ART)
FIG. 4 is a circuit of a stereophonic headphone with a 3-pole stereophonic plug.

An embodiment of the present invention will now be described according to FIGS. 6 to 8. In this embodiment, the same reference numerals will be used for the same components as the above-explained FIGS. 1 to 4.

Figure 6:
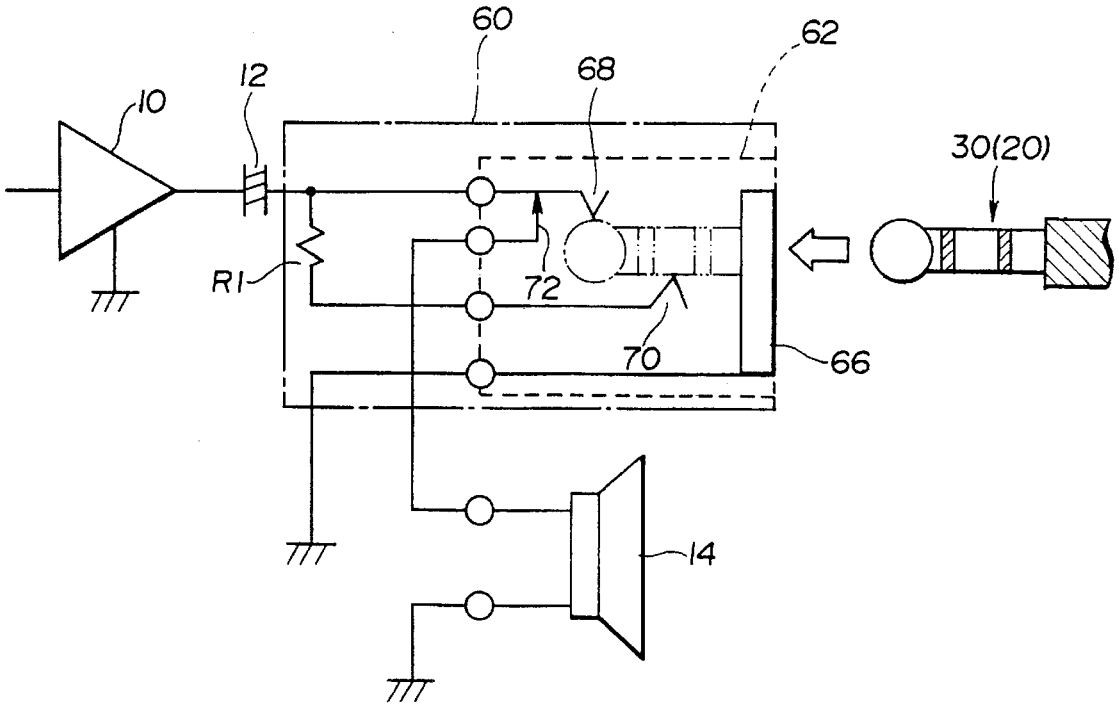
FIG. 6 is a block diagram of one embodiment of a connecting device according to the present invention.

FIG. 6 shows a telecommunication apparatus, such as a receiver or transceiver, in which a device for connecting external sound generators of the present invention is adopted. The telecommunication apparatus comprises a low frequency power amplifier 10 for generating an electrical sound signal. The output of the amplifier 10 is connected, via a DC cut-off capacitor 12, to a device 60 for connecting external sound generators. The amplifier 10 and capacitor 12 form an outputting circuit of an electrical sound signal of the present invention.

The connecting device 60 comprises a single common jack 62 for connecting external sound generators and a resistor R1 for preventing a short circuit. The common jack 62, as shown in the figure, has a minus contact 66, a first plus contact 68, a second plus contact 70, and an armature 72. The armature 72 is designed to open and close against the first plus contact 68 in response to the insertion and pulling out of the 3-pole stereophonic plug 30 or the 2-pole monophonic plug 20, as external sound generators of the present invention, which were described in FIGS. 3 and 1. Furthermore, the second plus contact 70 is coupled with the DC cut-off capacitor 12 through the short-preventing resistor R1. The armature 72 is coupled with a built-in speaker 14 of the telecommunication apparatus.

Figure 3:
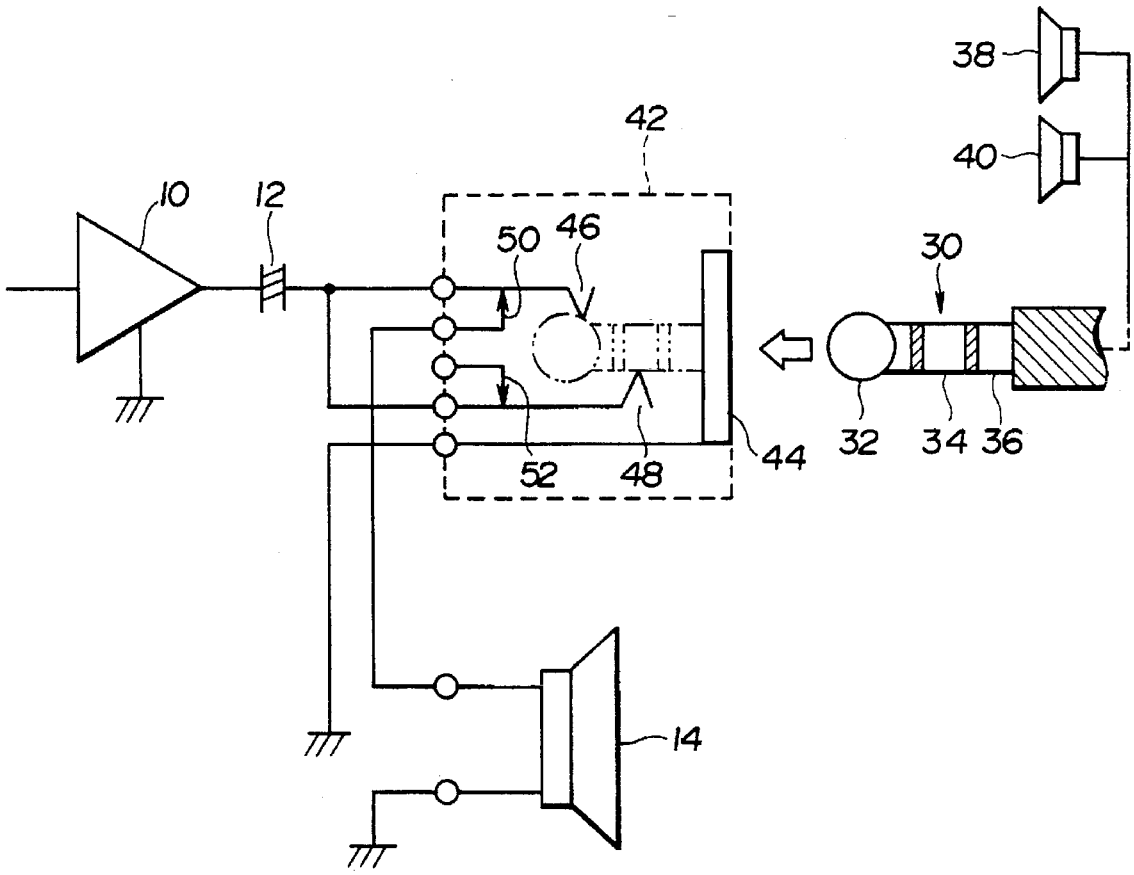
FIG.3 (PRIOR ART)
FIG. 3 is a block diagram of a conventional telecommunication apparatus having a typical 3-pole stereophonic jack.
Figure 5:
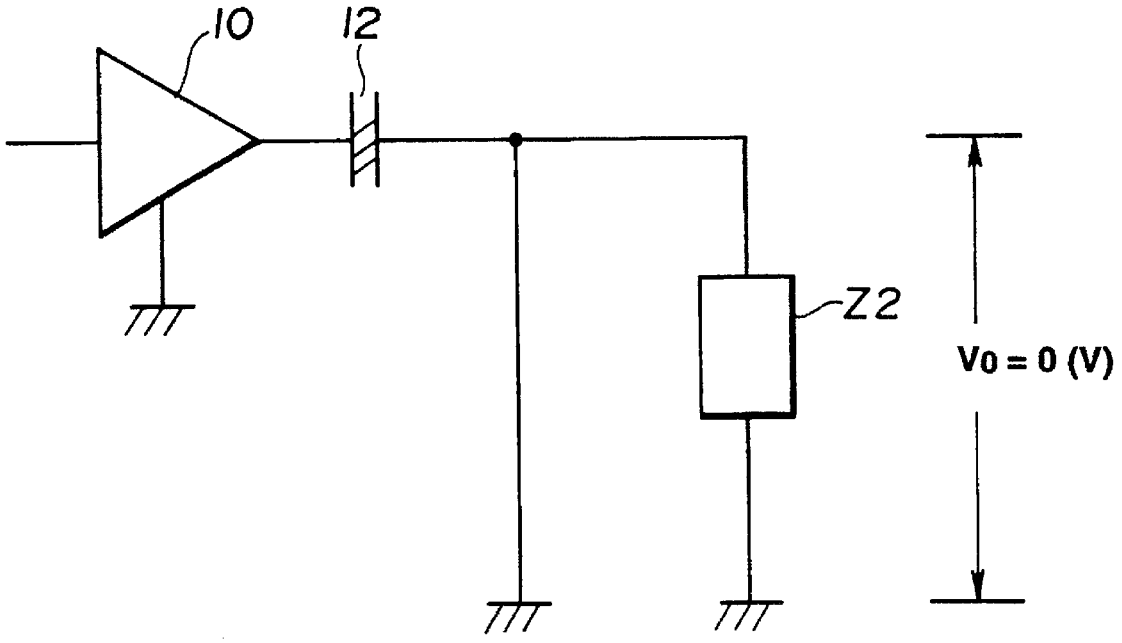
FIG.5 (PRIOR ART)
FIG. 5 is an equivalent circuit explaining a situation in which a 2-pole monophonic earphone is inserted into a typical 3-pole stereophonic jack.

When the 3-pole stereophonic plug 30 shown in FIG. 3 is inserted into the common jack 62 of the telecommunication apparatus, the left-channel and right-channel plus members 32 and 34 of the plug 30 make contact with the first and second plus contacts 68 and 70 of the jack 62, respectively, while the minus member 36 of the plug 30 touches the minus contact 66 of the jack 62. This insertion of the plug 30 enables the armature 58 to open against the first plus contact 68 in the jack 62. Such connection between the plug 30 and the jack 62 allows the left- and right-channel headphones 38 and 40 of the 3-pole stereophonic headphone to be connected to the low frequency power amplifier 10.

Figure 7:
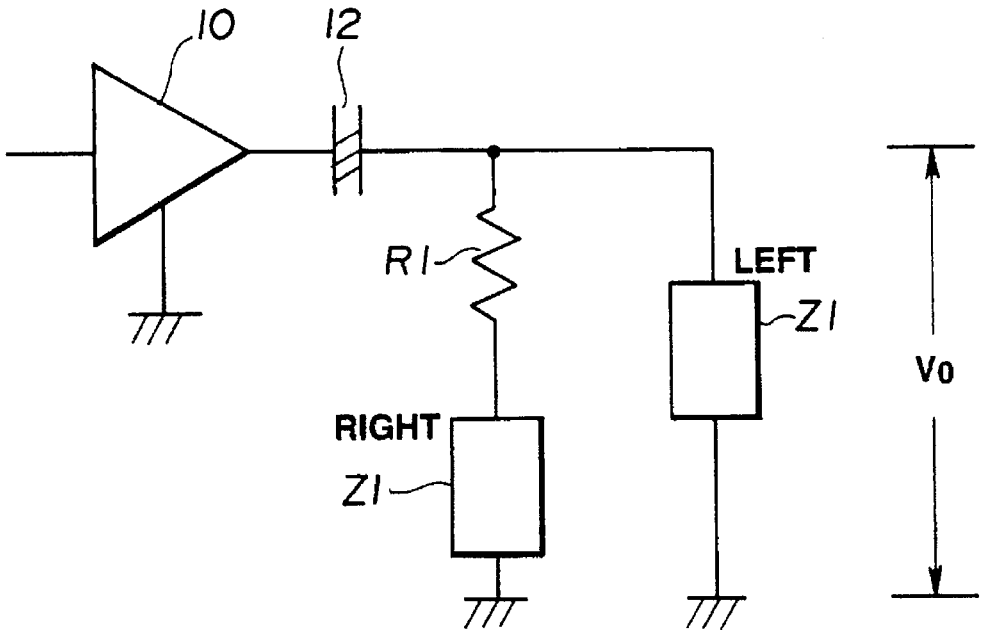
FIG. 7 shows an equivalent circuit for use of a headphone with a 3-pole stereophonic plug.

When the plug 30 is inserted in the jack 62, a equivalent circuit of the connecting device 60 can be shown as in FIG. 7, in which left-and right channel impedances of the stereophonic headphone are each Z1. As apparent from the equivalent circuit, a user can hear monophonic sound through the headphones 38 and 40 of both the channels.

Next is a case of the 2-pole monophonic plug 20. Inserting the plug 20 into the common jack 62 permits the plus member 22 of the plug 20 to touch the first plus contact 68 and the minus member 24 to touch both of the second plus contact 70 and the minus contact 66. The insertion of the plug 20 makes the armature 72 open against the first plus contact 68.

Figure 8:
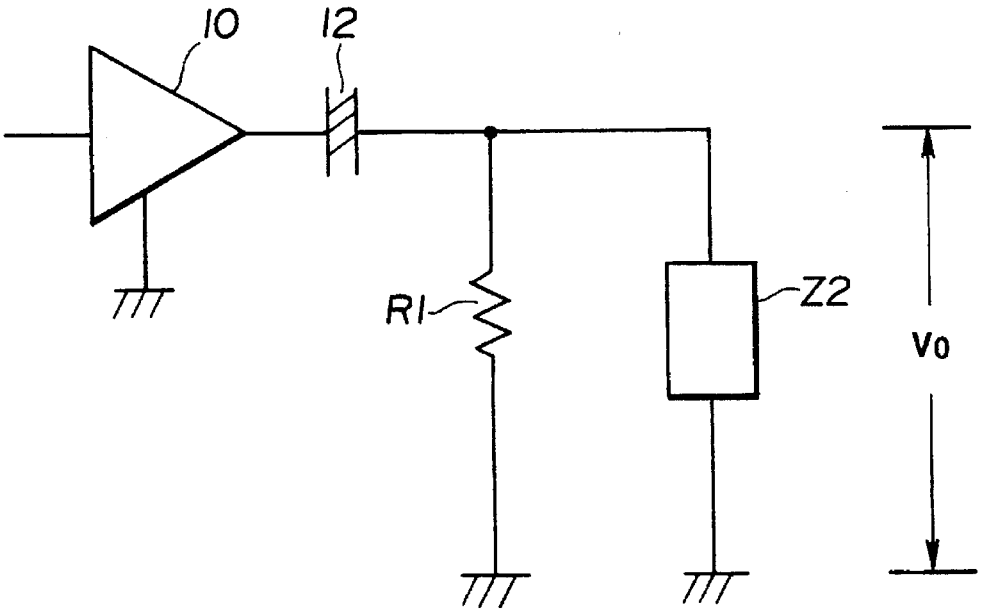
FIG. 8 shows an equivalent circuit for use of a earphone with a 2-pole monophonic plug.

Accordingly, an equivalent circuit of this time is expressed as in FIG. 8; the short-preventing resistor R1 is arranged to be in parallel with the impedance Z2 of the earphone, thus avoiding the output of the amplifier 10 to be shorted alternatingly. Therefore, one can also hear monophonic sound through the earphone 26.

Further, an appropriate resistance value of the short-preventing resistor R1 is given through the following consideration. In the connecting device 60 shown in FIG. 6, for use of the stereophonic headphone, as can be understood from FIG. 7, a larger resistance value of the short-preventing resistor R1 yields a larger difference in load impedances of the left- and right channels, resulting in a greater difference in sound volume. In contrast, a smaller resistance value of the resistor R1 decreases the load impedance of the amplifier 10, increasing consumption current. This increased current gives the amplifier 10 unfavorable conditions which should be avoided. Therefore, it is favorable that the resistance value be maintained within an appropriate range.

The resistance value is recommended to be in compliance with the following combined conditions; that is, a difference $SV_{diff}$ in sound volume calculated by the following formula is within 3 [dB] and the total load impedance satisfies impedance regulations of the amplifier 10 even when either one of the stereophonic headphone or the monophonic earphone is selectively connected.

$$SV_{diff}(dB)=20\log\{(R1+Z1)/Z1\}$$

As explained above, the connecting device 60 having one common jack 62 is preferably adoptable to both of the stereophonic headphone with the 3-pole stereophonic plug and the earphone with the 2-pole monophonic plug. Therefore, two jacks dedicated to the 3-pole stereophonic plug and 2-pole monophonic plug are not required to be arranged, thus lowering manufacturing cost and occupying less space to be compact.

A variation of the present invention will now be explained according to FIG. 9.

Figure 9:
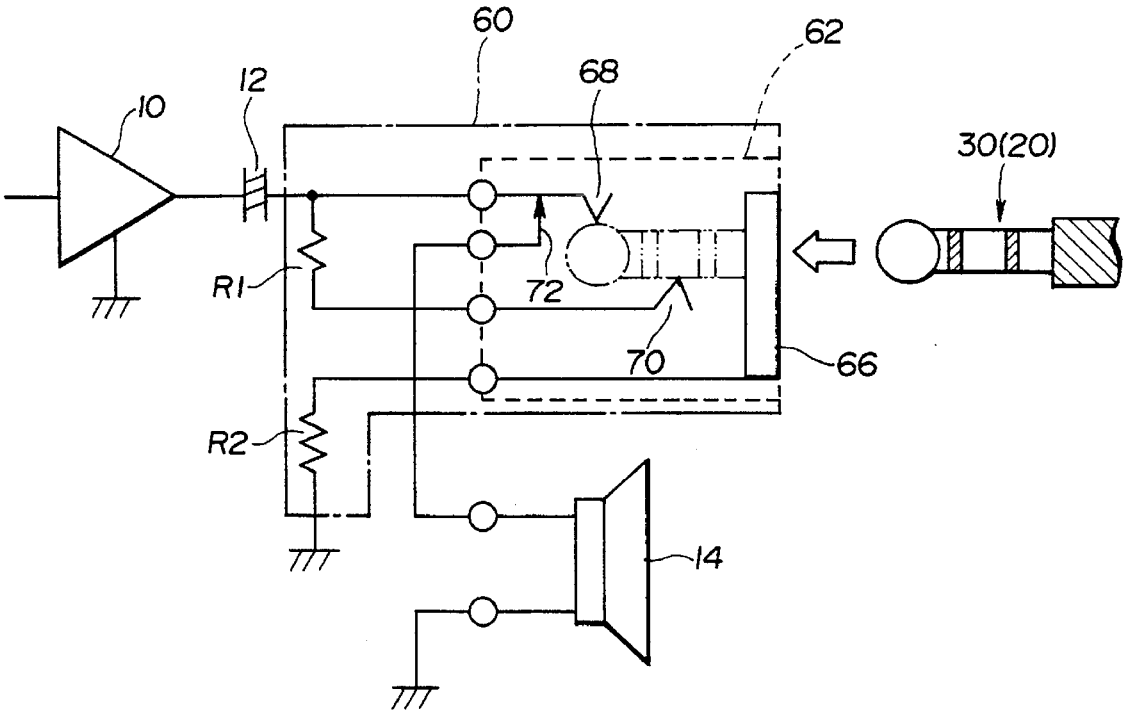
FIG. 9 is a block diagram of a variation of a connecting device according to the present invention.

A connecting device 60 shown in FIG. 9, also used in a telecommunication apparatus, has another resistor R2 for adjusting sound volume, in addition to the same components as those described in the aforementioned embodiment. The resistor R2 is connected between the minus contact 66 and the earth.

In consequence, when the stereophonic headphone or monophonic earphone is selectively used and the output power of the amplifier 10 becomes its maximum, it is possible that a damage is not given to ears or a headphone, earphone, owing to the resistor R2.

Figure 10:
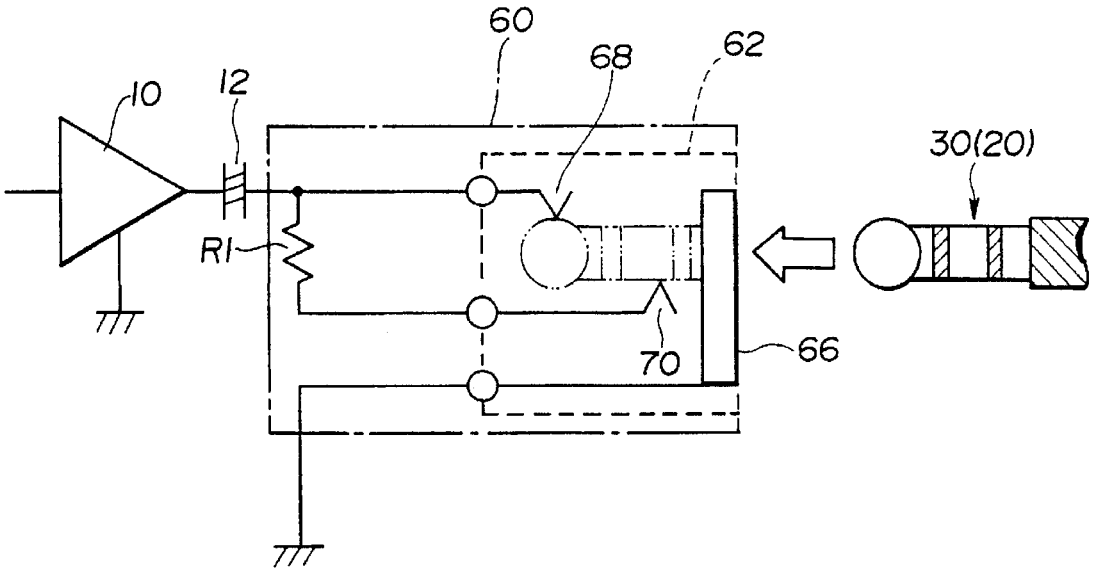
FIGS. 10 and 11 are block diagrams of further variations of a connecting device according to the present invention.
Figure 11:
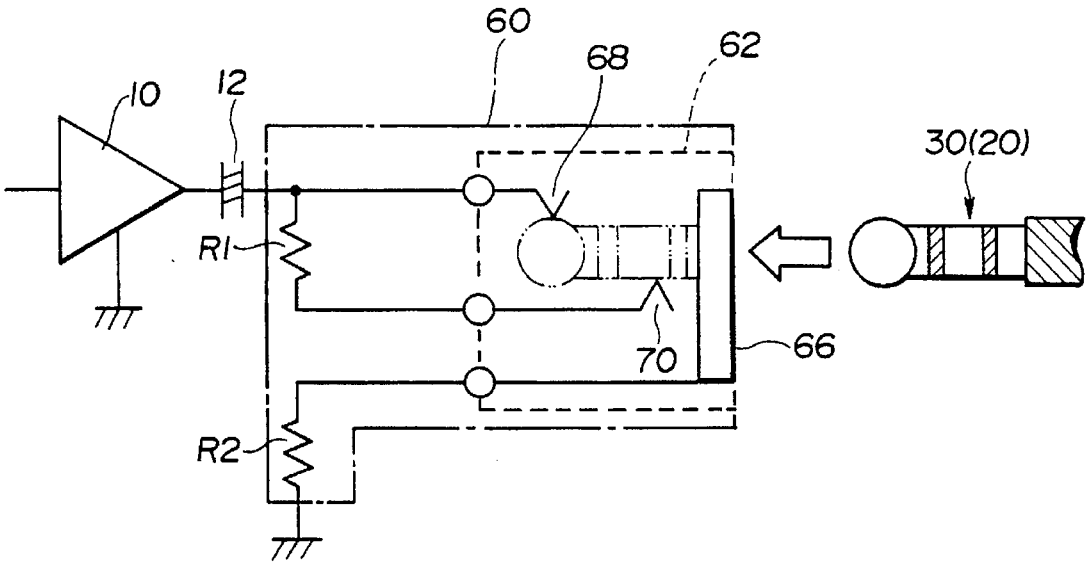

Further variations of the present invention are illustrated in FIGS. 10 and 11. Though FIGS. 10 and 11 correspond to the above-explained FIGS. 6 and 9, respectively, there is no built-in speaker in telecommunication apparatus shown in FIGS. 10 and 11. Therefore, an armature is omitted from the common jack 62 to be simplified in construction.

Although the above embodiments have explained the combination of a stereophonic headphone and a monophonic earphone, the present invention is not limited to such a combination; any combination such as a stereophonic earphone and a monophonic headphone can be adopted.

Obviously, numerous modifications and variations of the present invention are possible in light of the above teachings. It is therefore to be understood that within the scope of the appended claims, the invention may be practiced otherwise than as specifically described therein.

What we claim is:

1. A device for connecting an external sound generator having a plug with an apparatus having a circuit outputting an electrical sound signal and a built-in speaker, the external sound generator having either a stereophonic headphone having a 3-pole stereophonic type of plug or a monophonic headphone having a 2-pole monophonic type of plug, the device comprising:

a single jack having first and second plus contacts, a minus contact, and an armature opening and closing against the first plus contact in response to insertion and pulling out of the plug into and from the jack, the first and second plus contacts and the minus contact receiving the electrical sound signal from the outputting circuit through the first plus contact and supplying the electrical sound signal to the plug connected to the jack and the armature being connected to the built-in speaker;

a first electric resistor connected between the first and second plus contacts; said first electric resistor being provided so that a difference in sound volume $SV_{diff}$ as defined in Formula 1 below is within 3 dB:

$$SV_{diff}=20\log\{(R1+Z1)/Z1\}, \qquad \text{Formula 1}$$

wherein

R1=resistance of said first electric resistor and Z1=left and right channel impedances of the headphone; and a second electric resistor connected between the minus contact and ground for adjusting sound volume of the stereophonic headphone.

2. The device according to claim 1, wherein said outputting circuit comprises a low frequency power amplifier and a DC cut-off capacitor.

3. The device according to claim 2, wherein said apparatus is a telecommunication apparatus.

* * * * *